US005839746A

United States Patent [19]

Luitz

[11] Patent Number: 5,839,746

[45] Date of Patent: Nov. 24, 1998

[54] SKI BRAKE

[75] Inventor: Max Luitz, Blaichach/Bihlerdorf, Germany

[73] Assignee: Atomic Austria GmbH, Altenmarkt, Austria

[21] Appl. No.: 836,905

[22] PCT Filed: Jun. 28, 1996

[86] PCT No.: PCT/AT96/00114

§ 371 Date: May 2, 1997

§ 102(e) Date: May 2, 1997

[87] PCT Pub. No.: WO97/04842

PCT Pub. Date: Feb. 13, 1997

[30] Foreign Application Priority Data

Aug. 1, 1995 [AT] Austria ..... 1315/95

[51] Int. Cl.[6] ..... A63C 7/10

[52] U.S. Cl. ..... 280/605

[58] Field of Search ..... 280/604, 605, 280/601

[56] References Cited

U.S. PATENT DOCUMENTS 4,361,343 11/1982 Luitz .
4,500,106 2/1985 Svoboda .
4,564,211 1/1986 Luitz et al. .
4,872,698 10/1989 Szafranski .

FOREIGN PATENT DOCUMENTS 2255926 7/1975 France .
2646091 4/1978 Germany .

*Primary Examiner*—Richard M. Camby
*Attorney, Agent, or Firm*—Abelman, Frayne & Schwab

[57] ABSTRACT

In a ski brake (1) at least one brake arm (4) is mounted so as to be pivotable about an axis (D2) extending in parallel to the upper side of the ski. The brake arm (4) is articulately connected with a spring-loaded pedal plate (5) whose latching portion (7) in the braking position is supported by a supporting surface (9; 9') fixed relative to the ski, the pedal plate (5) being extended beyond its brake arm (4) pivot axis (D1). To prevent bending or breaking of the brake arm (4) in case of excessive load on the ski, the supporting surface (9; 9') has an associated abutment surface (10) fixed relative to the ski so as to form a latching indentation (8) for the latching portion (7); the arrangement being such that, if a pre-determined maximum force (F) acts on the brake arm (4), a safety unlatching of the latching portion (7) of the pedal plate (5) will occur against the force ($F_2$) of the spring (12) acting on the pedal plate (5).

25 Claims, 4 Drawing Sheets

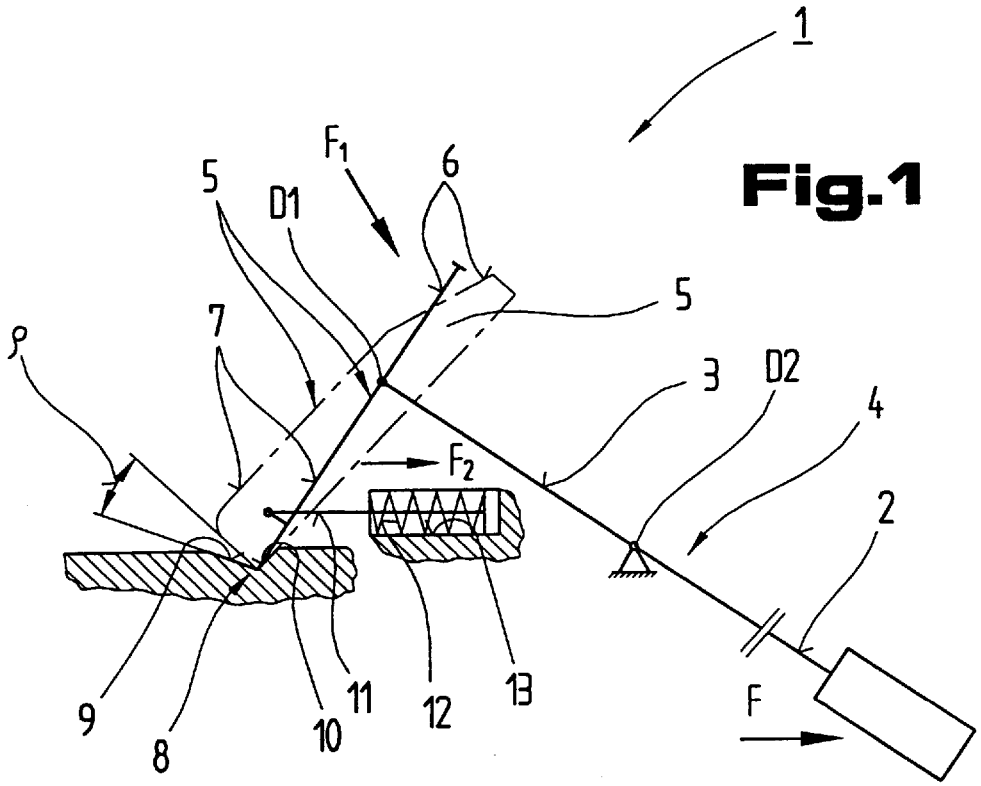
Fig.1
Fig.5
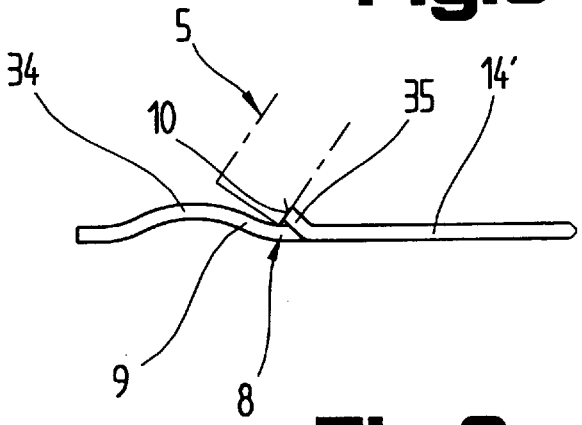
Fig.6
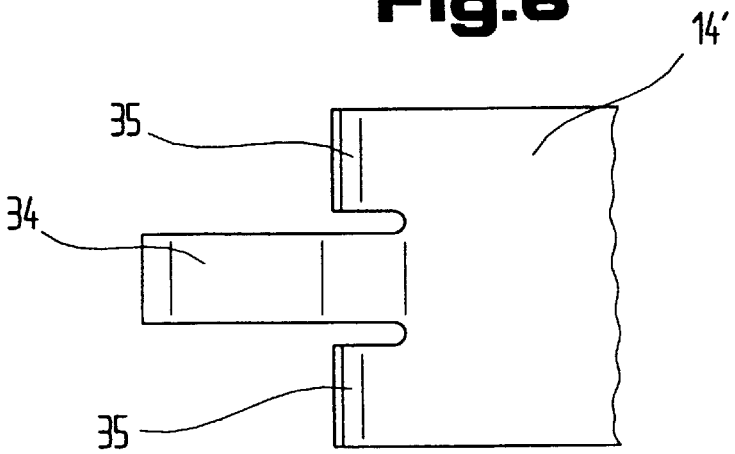

SKI BRAKE

The invention relates to a ski brake in which at least one brake arm is pivotably mounted about an axis fixed relative to the ski from a readiness position into a braking position and back, the axis fixed relative to the ski extending substantially in parallel to the ski upper side and at a right angle to the longitudinal axis of the ski, and the brake arm being connected with a pedal plate via a pivot axis extending in parallel to the pivot axis of the brake arm, and in which the pedal plate is biassed into the braking position by at least one spring and capable of being brought into the readiness position against the biassing force of the spring by pressing down, in which readiness position the free end of the brake arm is generally lifted to the lvel of the ski upper side, and in the braking position an end-side latching portion of the pedal plate being supported in the region of the ski upper side on a supporting surface fixed relative to the ski, and the pedal plate on the side opposite the latching portion being extended beyond its brake arm pivot axis so as to form an actuation portion for releasing the latching portion of the pedal plate from the supporting surface when pressing down the pedal plate.

From FR 2 255 926 A a ski brake is known in which a brake arm is mounted to be pivotable about an axis directly attached to the side face of a ski transversely to its longitudinal axis, from a readiness position into a braking position and back. The brake arm is connected with a pedal plate via a pivot axis extending in parallel to the pivot axis of the brake arm, a tension spring, one end of which is fastened to the pedal plate and its other end being fastened at the pivot axis of the brake arm, bringing the brake arm into the braking position if the pedal plate is not loaded. On the ski upper side, a longitudinal guide for the lower end of the pedal plate and consisting of an upper portion and a lower portion is fastened. The lower portion of the longitudinal guide has a ramp-shaped elevation extending transversely to the longitudinal axis of the ski, which elevation serves as a support for the lower end of the pedal plate in the braking position. When the upper end of the pedal plate extended beyond its pivot axis is pressed down, the lower end of the pedal plate moves upwards outwardly from the elevation of the lower portion of the longitudinal guide and slides forwards along the lower side of the upper portion of the longitudinal guide, until the brake arm is in the readiness position in which the upper edge of the brake arm is approximately located at the level of the ski upper side. What is a grave disadvantage is that if the brake arm is in the braking position and the ski is loaded more heavily, e.g. if someone steps on the ski externally of the ski binding, the brake arm may be bent or even broken.

A ski brake in which the pedal plate and the brake lever are interconnected in the manner of a toggle lever is further known from AT 380 794 B or from EP-77 006 B1. There, the lower or front end of the pedal plate is articulately connected with a ram which is guided in a housing and is biassed by a pressure spring in a manner that the brake lever is pivoted into the braking position. In the braking position, the pressure spring is only slightly tensioned, and thus only a rather moderate braking effect is attainable, since with the corresponding forces exerted thereon by the ground, the brake lever is pivoted back, contrary to the—slight—spring force. To counteract this, a strong pressure spring would have to be used, which is, however, detrimental with a view to stepping with the ski boot into the ski binding as well as with a view to the action of forces on the ski boot.

It is thus the object of the invention to provide a ski brake of the initially defined type, in which the brake lever in the braking position cannot simply be pivoted back towards the readiness position by an action of force merely from the ground, even if a rather weak spring is used for biassing the brake arm, so that nevertheless a very high braking effect will result, and in which, on the other hand, the break arm is to be released from its braking position if the ski is under heavy load while the brake arm is in its braking position, so as to avoid deformation or breaking of the brake arm.

The ski brake of the invention of the initially defined type is characterized in that the supporting surface has an associated pedal plate abutment surface fixed relative to the ski and extending approximately at a right angle to the supporting surface and forming a latching indentation together with the supporting surface for latching of the latching portion of the pedal plate, the arrangement being such that when a pre-determined maximum force acts on the brake arm, safety unlatching of the latching portion of the pedal plate will occur against the force of the spring acting on the pedal plate. The latching in of the latching portion of the pedal plate in the latching indentation ensures that the brake arm is fixed in the braking position so that an unintentional pivoting out of the braking position is avoided and thus a high braking effect is ensured, wherein the brake arm can be brought into the readiness position only by pressing down the pedal plate—when "stepping into" the binding. As a consequence, a relatively weak spring can be used in the ski brake according to the invention, to move the brake arm from the readiness position into the braking position, it furthermore being possible to dimension it such that the spring is nearly relaxed in the braking position. On the other hand, by designing the latching indentation and the latching portion in combination with the determining of the biassing force of the spring it can be achieved that the latching portion of the pedal plate "unlatches" from the latching indentation if a pre-determined maximum force (e.g. 200N) acting on the brake arm is exceeded, an "overload protection" for the brake arm thus being achieved in an efficient manner if excessively high forces are exerted thereon.

To provide for as ready an unlatching of the pedal plate from the latching indentation as possible—depending on the strength of the spring, but also on the coefficient of friction of the materials of pedal plate and latching indentation, advantageously the angle under which the abutment surface extends relative to the supporting surface is between 90° and 115°, preferably between 90° and 105°. At this choice of angle, it is ensured, on the one hand, that the brake lever remains fixed in the braking position as long as a braking force acts on it which is below a pre-determined amount; with higher forces, the brake lever can reliably "unlatch", on the other hand, so that damage to the brake lever (bending, braking, etc.) is avoided.

To additionally facilitate unlatching of the pedal plate from the latching indentation, particularly in a "safety instance", when excessive forces act on the brake arm, it is particularly suitable if the supporting ramp is designed as a resilient tongue.

To attain a ready movement of the pedal plate, and also to further facilitate unlatching of the pedal plate from the latching indentation, it is preferred that a roller is mounted on the pedal plate, which roller latchingly engages into the latching indentation. There, a rotatable roller forms the "latching portion", with which a particularly ready safety-unlatching takes place. Above all, it has been shown that in the instance of such a roller, also ice and snow cannot impair the safety-unlatching.

A structurally advantageous arrangement of the latching indentation is characterised in that the latching indentation is formed in a base plate mounted on the ski upper side. This base plate simultaneously is used to mount the brake arm.

On the other hand, it is also advantageous if a spacer plate is arranged below a base plate provided on the ski upper side, which spacer plate projects beyond the base plate by a portion in the longitudinal direction, the latching indentation being formed in this projecting portion of the spacer plate. There, the base plate may form the supporting surface for the ski boot, and usually it can consist of a bent steel plate, whereas the spacer plate below the base plate may serve as a mounting aid, wherein it may additionally form an accommodation for the spring which biasses the brake arm.

A particularly preferred embodiment of the ski brake is characterised in that at least one channel extending in the longitudinal direction of the ski is formed in the base plate or optionally in the spacer plate to guide a cable that is connected with the latching portion of the pedal plate, on the one hand, and with the spring, on the other hand. There, the cable may be guided without any problems in that the pedal plate is always abruptly drawn into the latching indentation if the ski brake is activated.

An advantageous further development of the ski brake here consists in that the cable is connected with a nipple or the like supported by a pressure spring surrounding the cable, which pressure spring is arranged and supported in a chamber at the end portion of the channel; this configuration enables a compact, space-saving manner of construction.

Advantageously, for changing the bias of the pressure spring, the cable is adjustably fastened in the nipple.

If a roller is provided, the cable advantageously is simply fastened to the axle of the roller of the pedal plate. This also ensures an effective introduction of force directly at the site in question, so as to ensure an abrupt movement into the brake position.

For an improved transmission of force with a ski boot to the pedal plate it is also advantageous if the extended portion of the pedal plate forming the actuating portion is chamfered towards its end.

To retain the pedal plate in the latching indentation also in case of a weak spring, it has also proved to be advantageous if the angle between the abutment surface and the supporting surface is smaller than $90°+\rho$, the tangent of $\rho$ being the coefficient of friction between the materials of the pedal plate and the latching indentation.

The invention will now be explained in more detail by way of preferred exemplary embodiments illustrated in the drawings, to which, however, it shall not be limited. Therein, FIG. 1 shows a schematic illustration of the principle of the ski brake according to the invention;

FIG. 5 is an elevation view of a part of a further modified emobdiment of the ski brake;

FIG. 6 is a top view of that part of that ski brake according to FIG. 5.

Figure 2:
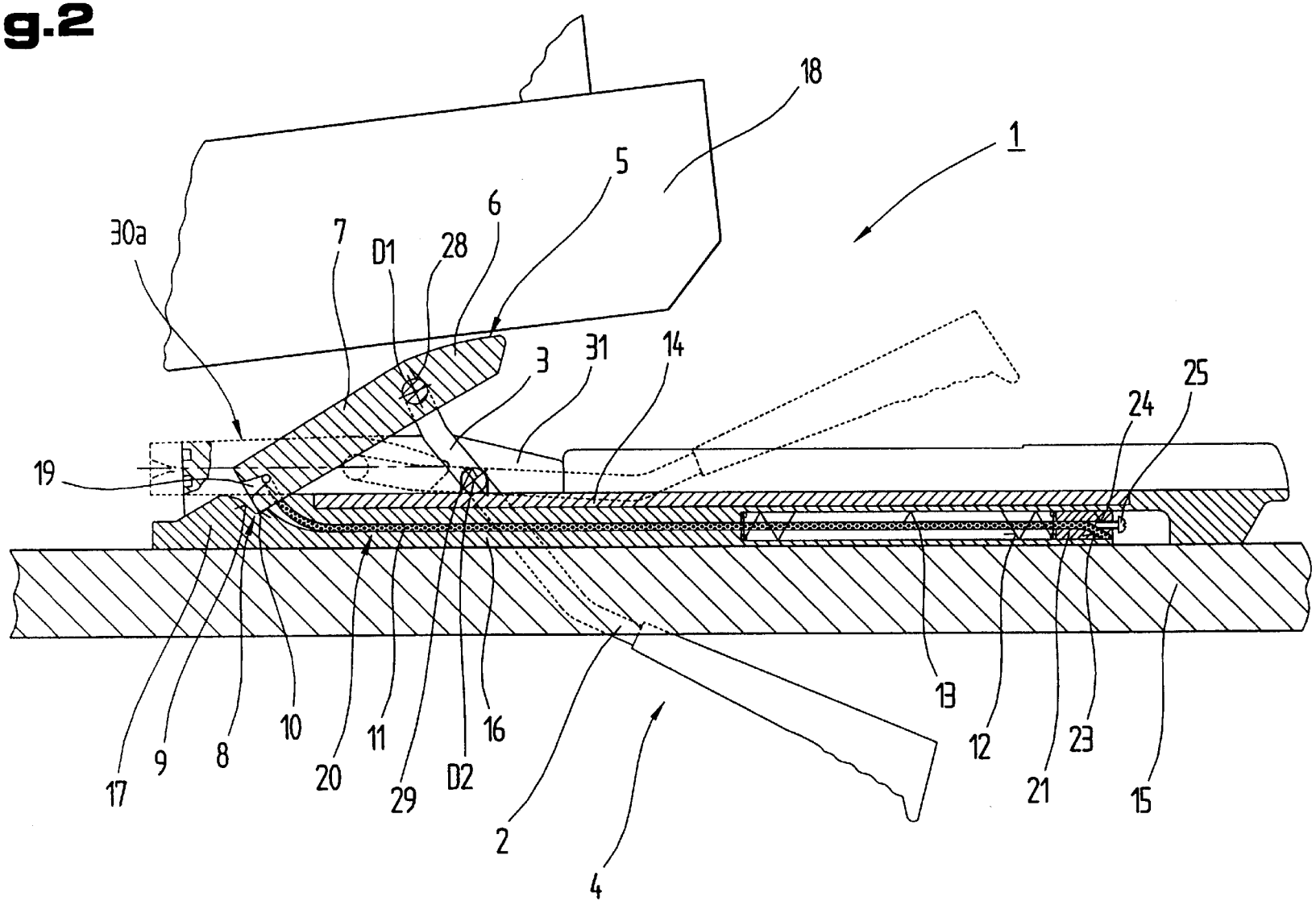
FIG. 2 shows a vertical section through the mean longitudinal section of one embodiment of the ski brake.

In the drawings, the entire respective ski brake is denoted by 1.

In the ski brake 1 schematically illustrated in FIG. 1, a brake lever is denoted by 2 and a crank arm of a brake arm 4 is denoted by 3, the brake arm 4 being hinged at a rotational axis D1 to a pedal plate 5. Usually two such brake arms 4, one on each longitudinal side of the ski, are provided, as is also apparent from FIG. 4. The brake arm 4 is pivotably mounted on a rotational or pivot axis D2 fixed relative to the ski. The actual structural design of the pedal plate 5 is indicated in dot-and-dash lines, and it is configured as a locking lever including an actuating portion 6 (formed by the upwardly extended portion of the pedal plate 5) and a latching portion 7 which, in the braking position of the ski brake 1 or of the brake arm 4, respectively, illustrated, latches into a latching indentation 8 fixed relative to the ski. The latching indentation 8 is comprised of a supporting surface 9 and an abutment surface 10, the angle between the supporting surface 9 and the abutment surface 10 being, e.g., 90° to 1052°, more generally 90° to 115°. In particular, the angle between the supporting surface 9 and the abutment surface 10 amounts to $90°+$an angle $\rho$, the tangent of $\rho$ being the coefficient of friction between the materials (e.g. POM= acetal homopolymerisate) of the pedal plate 5 and the latching indentation 8. The supporting surface 9 may, e.g., be rearwardly sloping (to the right, in FIG. 1) under e.g. an angle of from 30° to 60°, in particular approximately 45°, to the horizontal or to the ski upper side, respectively.

A cable 11 engages on the latching portion 7, which cable is connected with a biassed helical pressure spring 12 surrounding it over part of its longitudinal extension and being arranged in a housing or in a chamber 13 fixed relative to the ski and supported there, whereby a force $F_2$ is exerted on the latching portion 7 of the pedal plate 5.

As is apparent from FIG. 1, the angle between the brake arm 4 and the pedal plate 5 in the braking position amounts to at least substantially 90°, whereby it is ensured that a force F acting on the brake arm 4 in the braking position will not result in an unintentional unlatching of the pedal plate 5 from the latching indentation 8, as long as this braking force does not exceed a pre-determined maximum value, e.g. 200N. On the other hand, a force $F_1$ acting on the actuating lever arm 6 and exerted on the pedal plate 5—under pressing down and pivoting of the pedal plate 5—when stepping into the associated ski binding (not illustrated) with a ski boot, may cause a torque about the rotation axis D1, whereby the pedal plate 5 is pivoted or "unlatched" clockwise—according to the illustration in FIG. 1—from the latching indentation 8, and the brake arm 4 can then be brought from the braking position into a readiness position by pivoting about the rotational axis D2 fixed relative to the ski. If the pre-determined maximum force F is exceeded, the latching portion 7 can become unlatched from the latching indentation 8, if the geometry and the materials (i.e. the angle $\rho$) as well as the force $F_2$ of the spring 12, by which the latter is under bias, are chosen accordingly.

Figure 4:
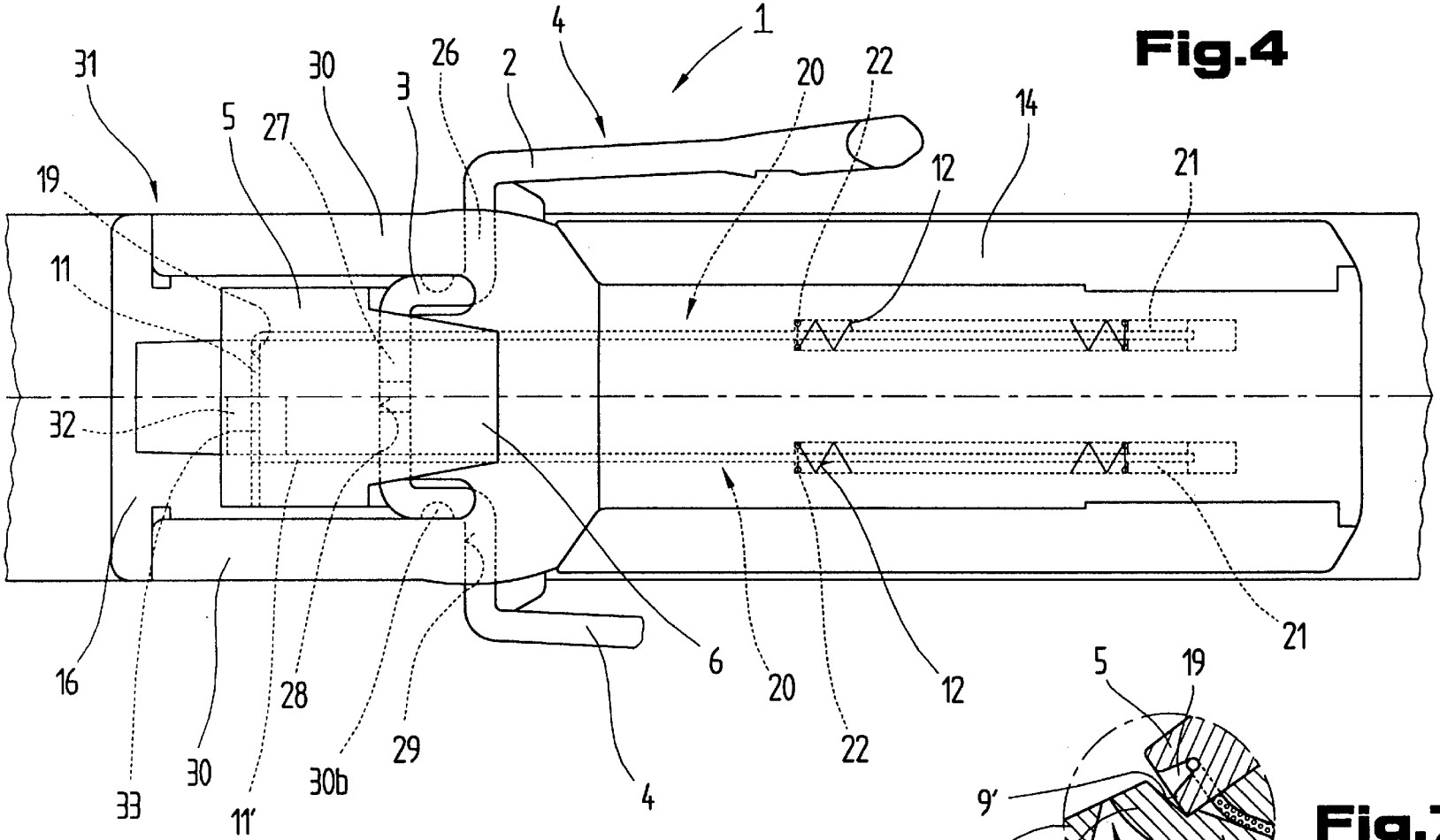
FIG. 4 shows top views of the ski brake illustrated in FIGS. 2 and 3, respectively, the embodiment according to FIG. 2 being shown above the ski longitudinal axis and the embodiment according to FIG. 3 being illustrated below the ski longitudinal axis.

In the embodiment of the ski brake 1 illustrated in more detail in FIGS. 2 and 4, a spacer plate 16 is arranged between a base plate 14 that serves for accommodating a heel holder of a ski binding (not illustrated) and a ski 15, which spacer plate projects forwardly beyond the base plate 14 by a portion 17 in the (ski) longitudinal direction; in this portion 17 of the spacer plate 16, the latching indentation 8 with the supporting surface 9 and the abutment surface 10 is formed.

The pedal plate 5 as well as one of the two brake arms 4 are illustrated in full lines in FIG. 2 in the braking position, and in broken lines in the readiness position. The upper extended portion of the pedal plate 5 forming the actuating portion 6 is chamfered towards the free end so as to enable a more ready unlatching of the pedal plate 5 from the latching indentation 8 by the heel portion of a ski boot 18 when stepping into the ski binding (not illustrated).

At the free, lower end of the latching portion 7 of the pedal plate 5 the cable 11 is fastened; in detail, according to the illustrations of FIG. 2, as well as of FIG. 4, in the upper half of the ski brake 1 illustrated above the ski-longitudinal axis (cf. also the detailed illustration of FIG. 7), the cable 11 designed in one piece is hooked in by clamping into a slot-shaped recess 19 at the lower end of the pedal plate 5 and guided backwards in the racing direction on either side of the pedal plate 5 via a channel 20 in the holding plate 16 and is fastened with its end on a nipple 21. At the end of each channel 20, a chamber 13 is provided in the holding plate 16 to accommodate the respective pressure spring 12, which is supported on the nipple 21, on the one hand, and on the shoulder-shaped transition 22 between the channel 20 and the chamber 13, on the other hand. According to FIG. 2, the nipple 21 has an inclined bore 23 through which the cable 11 is guided as well as a central threaded bore 24 with a screw 25, by means of which the cable 11 can be clamped tight in the respective position thereby rendering adjustable the bias of the pressure spring 12.

From the top view onto the ski brake 1 according to FIG. 4 it can be seen that the ski brake 1, in a conventional manner, has two brake arms 4 symmetrically arranged relative to the ski longitudinal axis. Each brake arm 4 is bent three times (approximately at right angles) so as to form a hinge shaft (pivot axis 26) between the brake lever 2 and the crank arm 3 as well as a hinge pin 27 at the free end of the crank arm 3, which hinge pin is rotatably journaled in a bore 28 in the pedal plate 5. The hinge shaft 26 directly contacts the base plate 14 and, laterally and upwardly supported in a U-shaped recess 29 (cf. in particular FIGS. 2, 3 and 4), is rotatably journaled in lateral support ledges 30 of a support plate 31 arranged above the base plate 14. The two support ledges 30 define the supporting area 30*a* for the ski boot and are connected with the base plate 14, e.g. by rivets, screws (not illustrated) and/or via latching projections (cf. e.g. at 30' in FIG. 3), etc.. The two hinge pins 27 may furthermore engage in inwardly widening bores 28 of the pedal plate 5, and laterally the two upright ledges 30 may be provided with cam projections 30*b* perpendicularly extending in the direction to the longitudinal axis of the ski for driving the brake arms 4 in the readiness position with their two brake levers 2 retracted into a position above the ski upper side and substantially within a normal projection thereon, as is common per se, cf. also EP-77 006 B1, e.g., where a similar course of movement is attained with vertical bearing pins.

Figure 3:
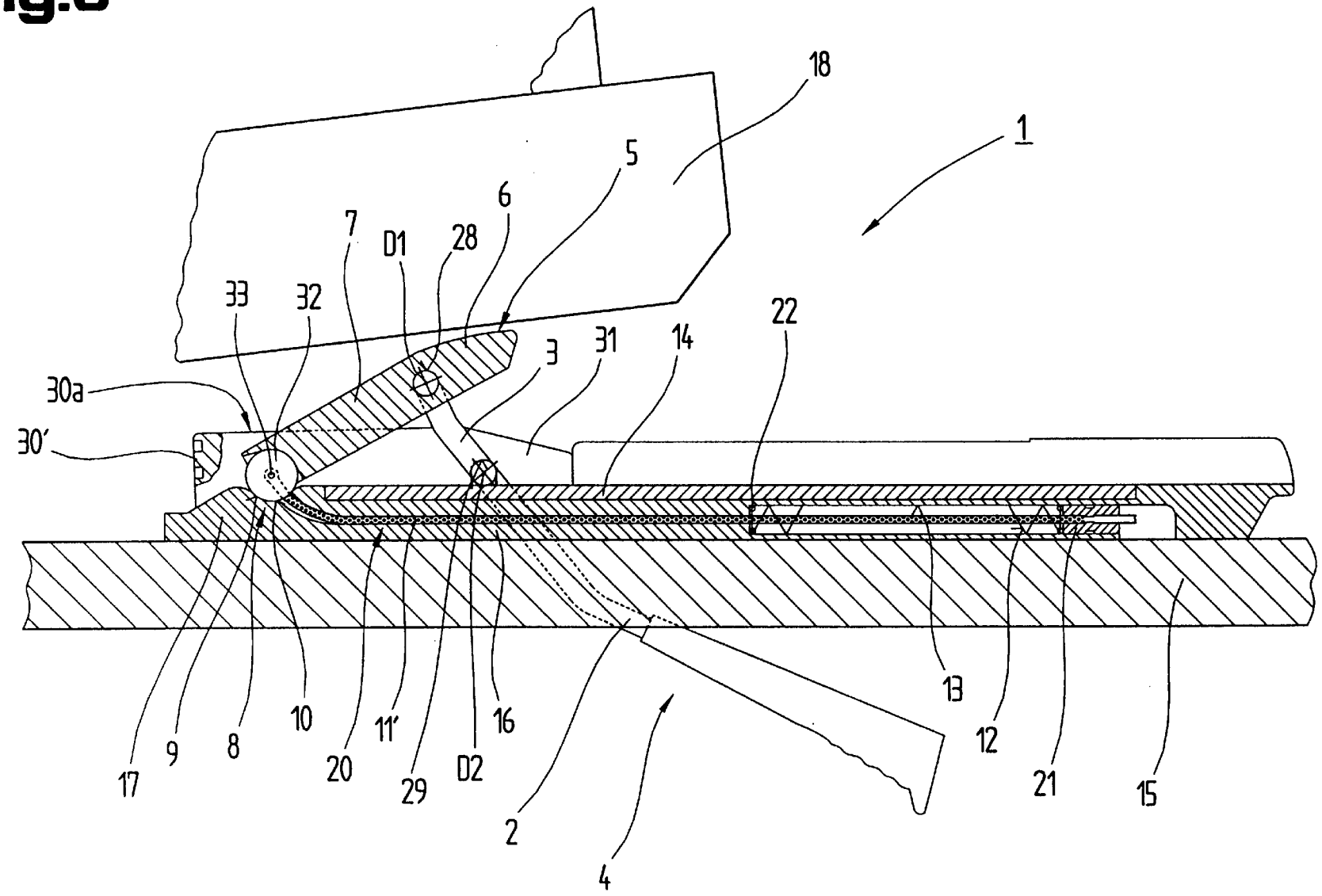
FIG. 3 shows such a vertical section of a presently particularly preferred embodiment of the ski brake, which has been modified as compared to FIG. 2.

In the ski brake 1 illustrated both in FIG. 3 and in the lower half of FIG. 4, below the longitudinal axis of the ski, which presently is considered the best mode, a roller 32 is journalled on an axle 33 at the lower end of the pedal plate 5 facing the latching indentation 8, the cable 11' designed in one part or in two parts being fastened to the axle 33. According to FIG. 3, each nipple. 21 furthermore is tightly connected with the cable 11' by pinching, whereby the bias of the pressure spring 12 becomes consistant, i.e. unchangeable.

FIGS. 5 and 6 illustrate a detail of a modified ski brake in which the latching indentation 8 is formed directly in the base plate 14', a central, arched, optionally resilient, tongue 34 forming the supporting surface 9 and two upwardly bent lugs 35 provided laterally of the tongue 34 forming the abutment surface 10 (or the two abutment surfaces 10, respectively) for the pedal plate 5. (The arrangement of these parts could, of course, also be the other way round, i.e. the abutment lug 35 is in the middle between two outer supporting surface tongues 34.) Otherwise, the ski brake can be configured as explained above by way of FIGS. 1 to 4, no further description thus being required.

Figure 7:
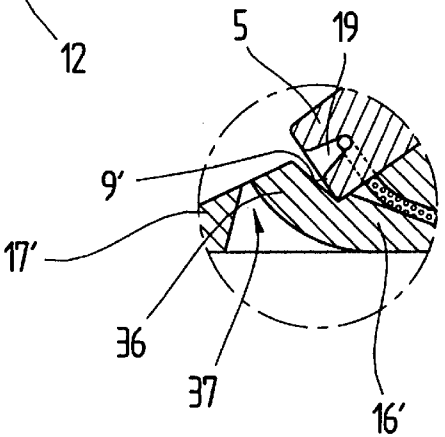
FIG. 7 shows a detail of a variant of a part of the ski brake according to FIG. 2.

FIG. 7 shows in detail a supporting surface 9' of a holding plate 16', which supporting surface is configured as a resilient tongue 36 of resiliently elastic synthetic material, in which a gap 37 is provided behind the tongue 36 in portion 17' of the spacer plate 16', the gap extending beyond the width of the pedal plate 5.

As is apparent from FIG. 2, in the readiness position, the lower side of the pedal plate 5 partly rests on the upper side of the base plate 14, and partly on the highest site of the supporting surface 9, i.e. the highest site of the supporting surface 9 registers with the upper side of the base plate 14. The latching portion 7 of the pedal plate 5 forms a toggle joint with the crank arm 3 of the brake arm 4, and for kinematic reasons, the rotational axis D1 in the readiness position being located above a virtual connecting line between the rotational axis D2 and the line of engagement of the cable 11 on the pedal plate 5.

In a concrete exemplary embodiment, the pedal plate 5 may have a total length of from 5 to 6 cm, the length ratio of latching portion 7 to actuating portion 6 being, e.g., generally 1.5:1; the distance between the two rotational axes D1 and D2 being e.g. approximately 25 mm, and the upper side of the pedal plate 5, in the braking position, assuming an angle of approximately 35° to the ski upper side. Furthermore, in the exemplary embodiment according to FIGS. 2 and 3, the ratio of the length of the brake lever 2 to that of the crank arm 3 is, e.g. approximately 4:1, and the ratio of the length of the crank arm 3 to that of the latching portion 7 being approximately 0.8:1; if the ratio of the length of the latching portion 7 to that of the actuating portion 6 is approximately 1:1.6, and with a (maximum) braking force F of from 150N to 250N on the brake arm 4 at the above length ratios, an elastic constant of the spring 12 of approximately 7N/mm will result if the brake lever 2 has, e.g. a length of 10 cm.

Although the invention has been explained above in detail by way of particularly preferred exemplary embodiments, further changes and modifications are, of course, possible; e.g., the base plate 14 may be integrally formed with the spacer plate 16, or tension springs (which then would have to be connected with the cable 11 by their front ends which are illustrated on the left-hand side according to the illustration of the drawings) may be used instead of the pressure springs 12.

I claim:

1. A ski brake to be mounted on a ski and comprising at least one brake arm having a free end and arranged so as to be pivotable about a first axis from a readiness position into a braking position and back, said first axis being arranged to extend substantially in parallel to a ski upper side and at a right angle to a longitudinal axis of the ski when the ski brake is mounted to a ski, a pedal plate pivotably connected with said brake arm via a second axis extending in parallel to said first axis, said pedal plate having an end-side latching portion and an opposite side, a roller journaled on the latching portion of said pedal plate, at least one spring biassing said pedal plate to urge said brake arm into the braking position, said pedal plate being capable of being brought into the readiness position against the biassing force of the spring by being pressed down, said free end of said brake arm in said readiness position being lifted to be generally level with the pedal plate, and said end-side latching portion of said pedal plate in said braking position being supported on a supporting surface fixed relative to the ski when the ski brake is mounted to the ski, the pedal plate on the side opposite the latching portion being extended beyond said second axis so as to form an actuation portion for releasing the latching portion of said pedal plate from said supporting surface when pressing down said pedal plate, said supporting surface having an associated pedal plate abutment surface fixed relative to the ski in the mounted state of the ski brake, and extending approximately at a right angle to said supporting surface and forming a latching indentation together with said supporting surface for latching of said latching portion of said pedal plate, said roller latchingly engaging in said latching indentation, safety-unlatching of said latching portion of said pedal plate occurring against the biassing force of said spring acting on the pedal plate if a pre-determined maximum force acts on said brake arm.

2. A ski brake as set forth in claim 1, wherein the supporting surface is established by a resilient tongue.

3. A ski brake as set forth in claim 1 further comprising a base plate to be mounted on the ski upper side, said base plate having said latching indentation formed therein.

4. A ski brake as set forth in claim 1, further comprising a base plate to be mounted on the ski upper side, and a spacer plate arranged below said base plate, said spacer plate projecting beyond said base plate by a portion in the direction of the longitudinal ski axis, said latching indentation being formed in said projection portion of said spacer plate.

5. A ski brake as set forth in claim 3, further comprising a cable connected with the latching portion of the pedal plate and with the spring, at least one channel extending in the longitudinal direction of the ski being formed in said base plate to guide said cable.

6. A ski brake as set forth in claim 4, further comprising a cable connected with the latching portion of the pedal plate and with the spring, at least one channel extending in the longitudinal direction of the ski being formed in the spacer plate to guide said cable.

7. A ski brake as set forth in claim 5, wherein said at least one channel has an end portion including a chamber and wherein said at least one spring is a pressure spring surrounding said cable, and further comprising a nipple supported by said pressure spring and connected with said cable, said pressure spring being arranged and supported in said chamber.

8. A ski brake as set forth in claim 7, wherein said roller has an axle and is journaled on the latching portion of the pedal plate, said cable being fastened to said axle of said roller.

9. A ski brake as set forth in claim 7, wherein said cable is adjustably fastened in said nipple for changing the bias of said pressure spring.

10. A ski brake as set forth in claim 1, wherein the extended portion of said pedal plate forming the actuating portion is chamfered towards its free end.

11. A ski brake as set forth in claim 1, wherein the angle between the abutment surface and the supporting surface is smaller than $90°+\rho$, the tangent of $\rho$ being the coefficient of friction between the materials of the pedal plate and the latching indentation.

12. A ski brake as set forth in claim 6, wherein said at least one channel has an end portion including a chamber and wherein said at least one spring is a pressure spring surrounding said cable, and further comprising a nipple supported by said pressure spring and connected with said cable, said pressure spring being arranged and supported in said chamber.

13. A ski brake as set forth in claim 1, wherein the angle under which the pedal plate abutment surface extends to the supporting surface is between 90° and 115°.

14. A ski brake as set forth in claim 13, wherein said angle is between 90° and 105°.

15. A ski brake to be mounted on a ski and comprising at least one brake arm having a free end and arranged so as to be pivotable about a first axis from a readiness position into a braking position and back, said first axis being arranged to extend substantially in parallel to a ski upper side and at a right angle to a longitudinal axis of the ski when the ski brake is mounted to a ski, a pedal plate pivotably connected with said brake arm via a second axis extending in parallel to said first axis, said pedal plate having an end-side latching portion and an opposite side, at least one spring biassing said pedal plate to urge said brake arm into the braking position, a base plate to be mounted on the ski upper side, and a spacer plate arranged below said base plate, said spacer plate projecting beyond said base plate by a portion in the direction of the longitudinal ski axis, said pedal plate being capable of being brought into the readiness position against the biassing force of the spring by being pressed down, said free end of said brake arm in said readiness position being lifted to be generally level with the pedal plate, and said end-side latching portion of said pedal plate in said braking position being supported on a supporting surface fixed relative to the ski when the ski brake is mounted to the ski, the pedal plate on the side opposite the latching portion being extended beyond said second axis so as to form an actuation portion for releasing the latching portion of said pedal plate from said supporting surface when pressing down said pedal plate, said supporting surface having an associated pedal plate abutment surface fixed relative to the ski in the mounted state of the ski brake, and extending approximately at a right angle to said supporting surface and forming a latching indentation together with said supporting surface for latching of said latching portion of said pedal plate, said latching indentation being formed in said projection portion of said spacer plate, safety-unlatching of said latching portion of said pedal plate occurring against the biassing force of said spring acting on the pedal plate if a pre-determined maximum force acts on said brake arm.

16. A ski brake as set forth in claim 15, wherein the angle under which the pedal plate abutment surface extends to the supporting surface is between 90° and 115°.

17. A ski brake as set forth in claim 16, wherein said angle is between 90° and 105°.

18. A ski brake as set forth in claim 15, wherein the supporting surface is established by a resilient tongue.

19. A ski brake as set forth in claim 15, further comprising a roller journaled on the latching portion of said pedal plate, said roller latchingly engaging in said latching indentation.

20. A ski brake as set forth in claim 15, further comprising a cable connected with the latching portion of the pedal plate and with the spring, at least one channel extending in the longitudinal direction of the ski being formed in the spacer plate to guide said cable.

21. A ski brake as set forth in claim 20, wherein said at least one channel has an end portion including a chamber and wherein said at least one spring is a pressure spring surrounding said cable, and further comprising a nipple supported by said pressure spring and connected with said cable, said pressure spring being arranged and supported in said chamber.

22. A ski brake as set forth in claim 21, further comprising a roller having an axle and journaled on the latching portion of the pedal plate, said roller latchingly engaging in the latching indentation and said cable being fastened to said axle of said roller.

23. A ski brake as set forth in claim 21, wherein said cable is adjustably fastened in said nipple for changing the bias of said pressure spring.

24. A ski brake as set forth in claim 15, wherein the extended portion of said pedal plate forming the actuating portion is chamfered towards its free end.

25. A ski brake as set forth in claim 15, wherein the angle between the abutment surface and the supporting surface is smaller than $90°+\rho$, the tangent of $\rho$ being the coefficient of friction between the materials of the pedal plate and the latching indentation.

* * * * *